United States Patent [19]

Inagaki et al.

[11] Patent Number: 5,002,466

[45] Date of Patent: Mar. 26, 1991

[54] VARIABLE-CAPACITY SWASH-PLATE TYPE COMPRESSOR

[75] Inventors: Mitsuo Inagaki, Okazaki; Seiichiro Suzuki, Nagoya; Kazuhito Miyagawa, Kariya, all of Japan

[73] Assignees: Nippondenso Co., Ltd., Kariya; Nippon Soken, Inc., Nishio, both of Japan

[21] Appl. No.: 316,662

[22] Filed: Feb. 28, 1989

[30] Foreign Application Priority Data

Mar. 2, 1988 [JP] Japan ..... 63-49229
Feb. 21, 1989 [JP] Japan ..... 1-41333

[51] Int. Cl.[5] ..... F04B 1/26

[52] U.S. Cl. ..... 417/222; 91/506; 92/12.2

[58] Field of Search ..... 417/222; 91/506; 92/12.2

[56] References Cited

U.S. PATENT DOCUMENTS

| | | | |
|---|---|---|---|
| 2,231,100 | 2/1941 | Wahlmark | 92/12.2 |
| 3,062,020 | 11/1962 | Heidorn | 417/222 |
| 4,061,443 | 12/1977 | Black et al. | 417/222 |
| 4,105,370 | 8/1978 | Brucken et al. | 417/222 |
| 4,108,577 | 8/1978 | Brucken et al. | 417/222 |
| 4,297,085 | 10/1981 | Brucken | 417/222 |
| 4,886,423 | 12/1989 | Iwanami et al. | 417/222 |

FOREIGN PATENT DOCUMENTS

| | | |
|---|---|---|
| 0259760 | 3/1988 | European Pat. Off. . |
| 3603931 | 8/1986 | Fed. Rep. of Germany . |
| 2424423 | 11/1979 | France . |

*Primary Examiner*—Leonard E. Smith
*Assistant Examiner*—John A. Savio, III
*Attorney, Agent, or Firm*—Cushman, Darby & Cushman

[57] ABSTRACT

A swash-plate type compressor comprises a plurality of cylinder chambers parallel to each other, a shaft, a swash plate connected to the shaft for rotation therewith and for wobbling motion due to the rotation, and a plurality of pistons subject to wobbling motion of the swash plate for reciprocation within the respective cylinder chambers. The shaft and the swash plate are connected to each other through a slot formed in one of them and a pin provided on the other, so the swash plate can wobble. A position of a center of rotation of the swash plate is supported by a spool device movable in coaxial relation to the shaft. Displacement of the spool device causes the position of the center of rotation of the swash plate and an inclination thereof to be varied to vary a reciprocative stroke of each piston, thereby controlling discharge capacity of the compressor. The engaging slot has a section thereof between positions corresponding respectively to a maximum discharge capacity and an intermediate discharge capacity of the compressor, which section is formed into a nonlinear configuration in such a manner that an angle between a normal line of the slot and an axis of the shaft decreases at a position corresponding to a large discharge capacity of the compressor, thereby restraining an increase in inclined moment acting upon the swash plate due to a dead volume occurring in the working chamber on one side of the piston at a large capacity of the compressor.

10 Claims, 8 Drawing Sheets

MINIMUM CAPACITY STATE

MINIMUM CAPACITY STATE

VARIABLE-CAPACITY SWASH-PLATE TYPE COMPRESSOR

BACKGROUND OF THE INVENTION

The present invention relates to a variable-capacity swash-plate type compressor which is effective for use as a refrigerant compressor of an air conditioning system for automotive vehicles, for example.

In the prior application (U.S.A.: Ser. No. 147,036 on Jan. 20, 1988/CIP of Ser. No. 91,982 on Sep. 1, 1987), one of the inventors of this application and others have proposed that, in a swash-plate type compressor in which fluid is compressed within a pair of working chambers arranged respectively at opposite ends of each piston, an angle of inclination of a swash plate is varied while preventing a dead volume from increasing uniformly in each of the working chambers at the opposite ends of the piston, thereby controlling the capacity of the compressor continuously.

The swash-plate type compressor is arranged such that a spool is engaged with the swash plate rotatively driven by a shaft, and an angle of inclination of the swash-plate is reduced by axial movement of the spool, to alter the stroke of the piston. Further, the arrangement is such that a spherical bearing is arranged at the center of the swash plate, and is also displaced in synchronism with the spool. With such arrangement, while the dead volume increases considerably in one of the pair of working chambers, the capacity decreases gradually without being accompanied with a considerable increase of a dead volume in the other working chamber. Accordingly, the capacity of the compressor can be controlled continuously in compliance with displacement of the spool.

There may be a case in the swash-plate type compressor that the spool is not displaced well under the influence of a dead space produced in one of the pair of working chambers at the opposite ends of the piston, in a state in which an amount of decrease in the stroke of the piston is small, in other words, in a state in which the discharge capacity of the compressor decreases more or less from the maximum discharge capacity. By this reason, supplementing load means is provided for supplementing the displacement of the spool, thereby enabling the displacement of the spool to be controlled even if the displacement of the spool is in the state described above.

However, the above supplementing means requires a spring unit considerably high in spring constant, so that the design of the spring unit is difficult from the viewpoint of stress. Further, since the spring force is excessively strong in case of a low compression ratio, pressure of control fluid required to bring the capacity of the compressor to the maximum against the spring force exceeds the discharge pressure of the compressor. Thus, there may be a case where it is made difficult to secure the control fluid.

SUMMARY OF THE INVENTION

It is an object of the invention to provide a swash-plate type compressor capable of suitably controlling its capacity from the minimum to the maximum without the use of especial supplementing means.

For the above purpose, a swash-plate type compressor according to the invention is arranged such that one of a swash plate and a shaft is formed with an engaging slot, and a pin fixed to the other is inserted in the slot, thereby connecting the swash plate to the shaft swingably. The engaging slot is formed into a nonlinear configuration having an inflection point at a location corresponding to an intermediate discharge capacity of the compressor, in such a manner that an inclination of a normal line of the slot with respect to the axis of the shaft decreases when the discharge capacity of the compressor is brought to a large capacity. By forming the engaging slot into the configuration described above, inclined moment occurring due to action of the compressor pressure to the swash plate, that is, fluctuation in moment attendant upon the dead space occurring in one working chamber is restrained, making it possible to control the discharge capacity of the compressor continuously.

According to the invention, there is provided a variable-capacity wobble-plate type compressor comprising: a housing having defined therein a plurality of cylinder chambers extending parallel to each other; a shaft rotatably supported by the housing and extending parallel to the plurality of cylinder chambers; a swash plate connected to the shaft for rotation therewith and for wobbling motion due to the rotation; a plurality of pistons slidably arranged respectively within the cylinder chambers, each of the pistons being subject to the wobbling motion of the swash plate means and being reciprocated within a corresponding one of the cylinder chambers; a plurality of pairs of first and second chambers, each pair of first and second chambers being defined respectively at opposite ends of a corresponding one of the pistons by the piston and an inner surface of a corresponding one of the cylinder chambers, to carry out suction, compression and discharge of fluid; a spool arranged for movement in coaxial relation to the shaft, the spool retaining the swash plate for wobbing motion at a center of rotation of the swash plate, wherein movement of the spool causes a position of the center of rotation of the swash plate to be displaced axially of the shaft and causes the swash plate to be varied in inclination, thereby varying a reciprocative stroke of each piston, so as to make forwardly-movable positions of the pistons in the respective first working chambers and forwardly-movable positions of the pistons in the respectively second working chambers different from each other; the shaft and the swash plate being connected to each other through slidable engagement between an engaging slot formed in one of the shaft and the swash plate and a pin provided on the other; and the engaging slot having at least a section thereof between positions corresponding respectively to a maximum discharge capacity and an intermediate discharge capacity of the compressor, the section being formed into a nonlinear configuration in such a manner that an angle defined between a normal line of the engaging slot and an axis of the shaft decreases at a position where the compressor is brought to a large discharge capacity.

BRIEF DESCRIPTION OF THE DRAWINGS

The above and other objects, features and advantages of the invention will become more apparent from the ensuing detailed description and appended claims taken in conjunction with the accompanying drawings, in which:

DETAILED DESCRIPTION OF THE PREFERRED EMBODIMENTS

Referring first to FIGS. 1 through 4, the construction and the operation of a swash-plate type compressor of an air conditioning system for automotive vehicles, to which the invention is applied, will be described.

Figure 1:
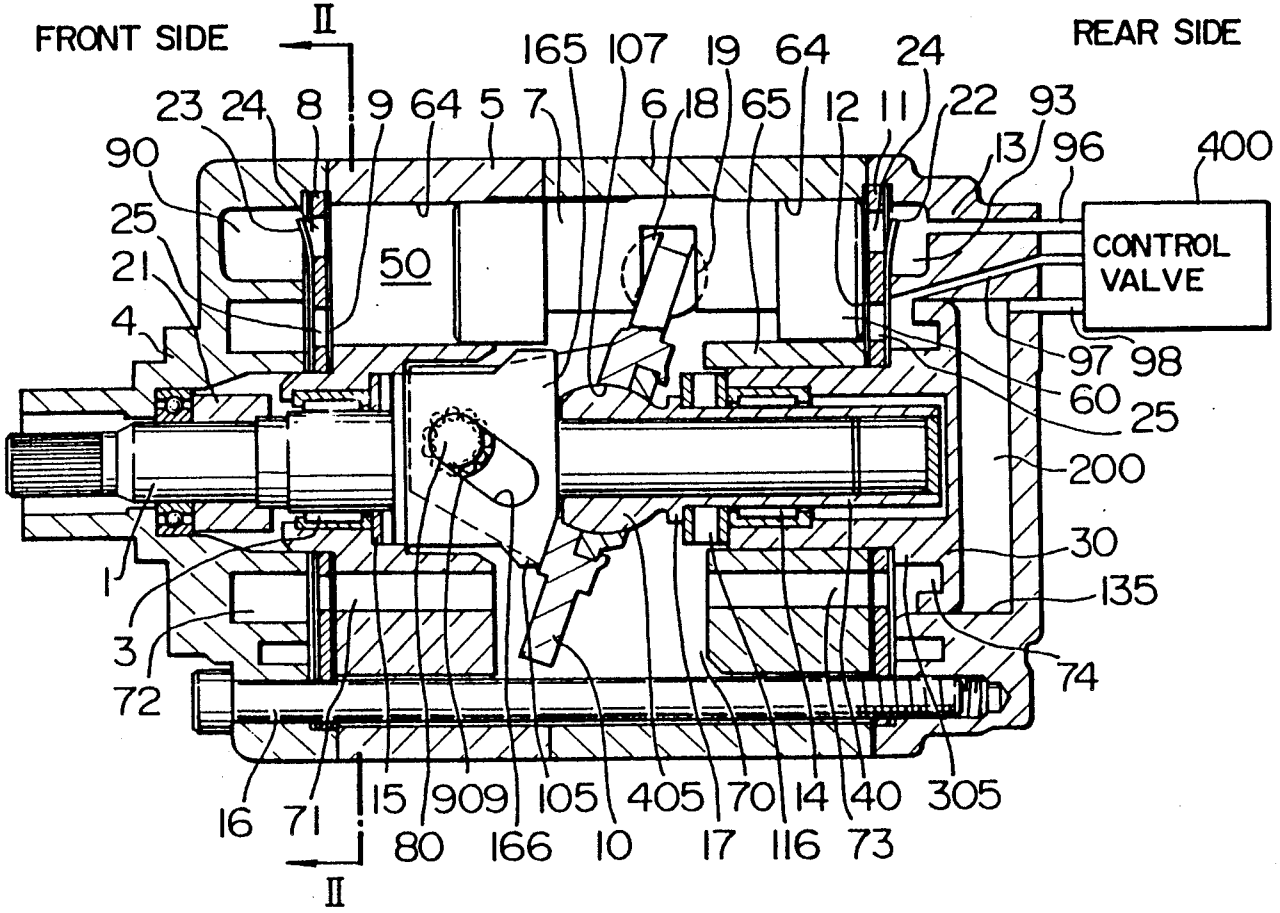
FIG. 1 is a cross-sectional view of an example of a swash-plate type compressor to which the invention is applied.
Figure 2:
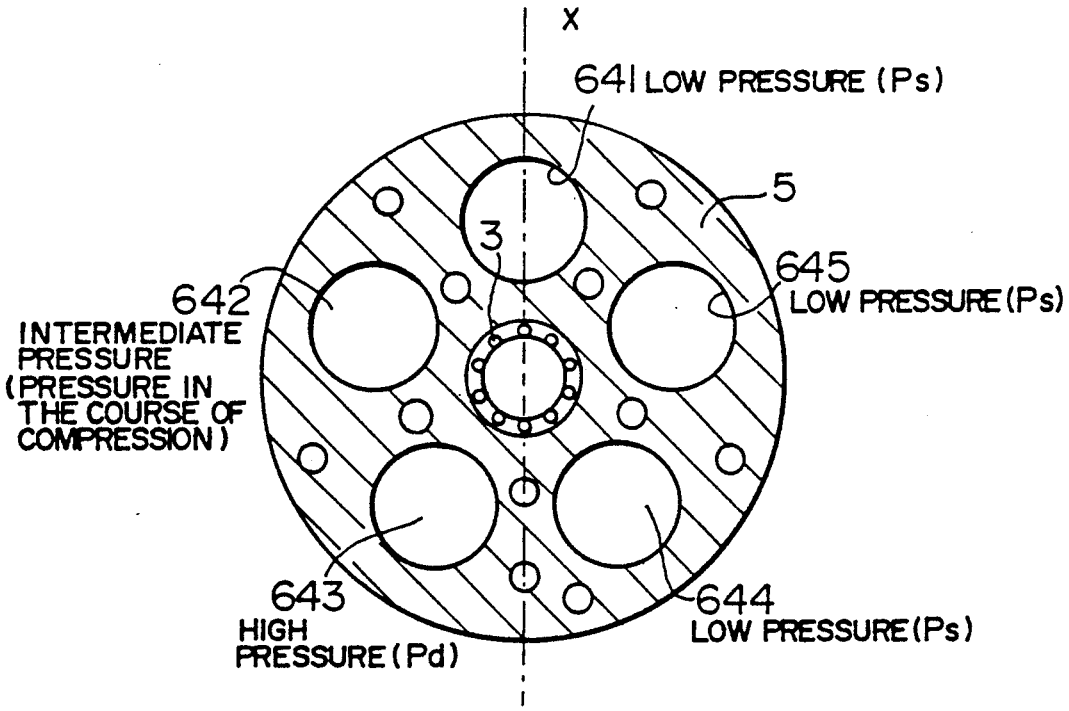
FIG. 2 is a cross-sectional view taken along the line II—II in FIG. 1.

FIG. 1 is a longitudinal cross-sectional view of a variable-capacity swash-plate type compressor. The compressor comprises an outer shell composed of a front housing 4, a front side plate 8, suction valves 9, a front cylinder block 5, a rear cylinder block 6, suction valves 12, a rear side plate 11 and a rear housing 13 which are formed of aluminum alloy and which are connected together by through bolts 16. The cylinder blocks 5 and 6 are formed therein with five cylinders 64 (641 through 645) as shown in FIG. 2, such that the cylinders 64 have their respective axes extending parallel to each other. A shaft 1 rotated under driving force from an engine for running an automotive vehicle is rotatably supported by the cylinder block 5 through a bearing 3. Thrust force acting upon the shaft 1, that is, force acting to the left as viewed in FIG. 1 is born by the front cylinder block 5 through a thrust bearing 15.

The shaft 1 has a rearward end, that is, a right-hand end as viewed in FIG. 1, which is inserted in a cylindrical slide section 40. The slide section 40 is rotatably supported by a cylindrical spool 30 through a bearing 14. Thrust force acting upon the slide section 40, that is, force acting to the right as viewed in FIG. 1 is born by the spool 30 through a shoulder 17 on the slide section 40 and a thrust bearing 116. The spool 30 is supported axially slidably in a cylindrical section 65 of the rear cylinder block 6 and a cylindrical section 135 of the rear housing 13.

A swash plate 10 is arranged within the cylinder blocks 5 and 6. The swash plate 10 is formed at its center with a spherical surface section 107. A spherical support portion 405 provided at the end of the slide section 40 is engaged with the spherical surface section 107. Thus, the swash plate 10 is supported by the spherical support portion 405 in a swingable manner.

The swash plate 10 has a front-side projection formed with a slit 105. A flat plate section 165 is formed at a portion of the shaft 1, which corresponds to the front-side projection on the swash plate 10. The flat plate section 165 is so arranged as to be in surface contact with an inner wall of the slit 105, whereby rotational driving force given to the shaft 1 is transmitted to the swash plate 10.

A pair of shoes 18 and 19 are arranged slidably at a peripheral edge of the swash plate 10 and at a location corresponding to each cylinder 64. A piston 7 is slidably arranged in each cylinder 64 formed in the cylinder blocks 5 and 6, to define a pair of working chambers 50 and 60 at the respective opposite ends of the piston 7. The pair of shoes 18 and 19 are mounted respectively to the opposite sides of the swash plate 10 slidably as described above. The pair of shoes 18 and 19 are engaged rotatably with a recess formed at an axial center of the piston 7. Thus, swinging motion of the swash plate 10 attendant upon rotation thereof is transmitted to the piston 7 through the shoes 18 and 19 as reciprocative motion. In this connection, the shoes 18 and 19 are so formed as to define a common spherical surface when they are assembled onto the swash plate 10.

The flat plate section 165 of the shaft 1 is provided with a slot 166 which is inclined with respect to the axial direction of the shaft 1. The slit 105 in the swash plate 10 is formed with a pin-inserting bore. After the flat plate section 165 of the shaft 1 has been arranged in the slit 105 of the swash plate 10, the pin-inserting bore of the slit 105 and the slot 166 in the shaft 1 are connected to each other through a pin 80 and a bearing 909 which supports the pin 80 rotatably in the pin-inserting bore. An inclination of the swash plate 10 varies depending upon a position of the pin 80 within the slot 166. In this connection, simultaneously with variation of the inclination, a position of the center of the swash plate 10 also varies, that is, a position of the spherical surface section 107 and the spherical support portion 405 also varies.

The reference numeral 21 in FIG. 1 denotes a shaft-seal device arranged within the front housing 4, for preventing refrigerant gas and lubricating oil from leaking to the outside along the shaft 1. The reference numeral 24 denotes discharge ports which are provided respectively in the side plates 8 and 11. The discharge ports 24 open respectively to the working chambers 50 and 60, and communicate respectively with discharge chambers 90 and 93 within the front and rear housings 4 and 13. The discharge ports 24 are opened and closed respectively by discharge valves 22 and 23.

The reference numeral 25 in FIG. 1 designates suction ports provided respectively in the side plates 8 and 11. Through the suction ports 25, the working chambers 50 and 60 communicate respectively with suction chambers 72 and 74 within the front and rear housings 4 and 13. The suction ports 25 are so designed as to be opened and closed respectively by the suction valves 9 and 12.

The reference numeral 400 in FIG. 1 designates a control valve for controlling pressure within a control pressure chamber 200 which is defined at the rearward end of the spool 30. One port of the control valve 400 communicates with the rear-side suction chamber 74 through a low-pressure introducing passage 97. The other port of the control valve 400 communicates with the discharge chamber 93 through a restriction and a high-pressure introducing passage 96 and also communicates with the control pressure chamber 200 through a control pressure passage 98. Thus, the pressure within the suction chamber 74 and the pressure within the control pressure chamber 200 act respectively upon the opposite sides of a flange at the rearward end of the spool 30.

The discharge chamber 90 on the front side in FIG. 1 communicates with a discharge port through a discharge passage formed in the cylinder block 5. On the other hand, the discharge chamber 93 on the rear side communicates with a discharge port through a discharge passage formed in the cylinder block 6. Both the discharge ports are connected to each other by outside piping, so that the discharge chambers 90 and 93 are made equal in pressure to each other. Moreover, the suction chamber 72 on the front side communicates with a suction space 70 formed at the center of the cylinder blocks 5 and 6, through a suction passage 71. Likewise, the suction chamber 74 on the rear side communicates with the suction space 70 through a suction passage 73 formed through the rear cylinder block 6.

The operation of the compressor constructed as above will be described. When an electromagnetic clutch (not shown) is moved to its engaged position and the shaft 1 starts to be rotated by driving of the engine of the automotive vehicle, the rotation of the shaft 1 causes each piston 7 to be reciprocated through the swash plate 10. With the reciprocative movement of the piston 7, suction, compression and discharge of refrigerant are carried out within the working chambers 50 and 60, as illustrated in FIG. 2.

In connection with the above, force due to a differential pressure between the working chamber 60 on the rear side and the working chamber 50 on the front side is applied to the swash plate 10 through the piston 7 and the shoes 18 and 19. Since, particularly, the swash plate 10 is swingably supported by the spherical support portion 405 of the slide section 40, and is subject to the rotational force of the shaft 1 through fitting between the slit 105 and the flat plate section 165, force applied to the piston 7 acts as moment in such a direction as to reduce the angle of inclination of the swash plate 10.

Figure 3:
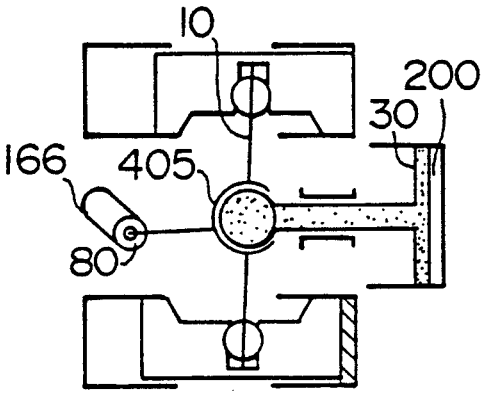
FIG. 3 is a view for explanation of a minimum capacity state of the compressor illustrated in FIG. 1.

Specifically, in a state in which suction pressure is introduced into the control pressure chamber 200 by the control valve 400, the spherical support portion 405 and the spool 30 are displaced to the right as viewed in FIG. 3. As a result, the swash plate 10 is reduced in its angle of inclination. Since, however, the swash plate 10 is restricted by the pin 80 fitted in the slot 166 of the shaft 1, the swash plate 10 is reduced in its inclination, and exerts force to the right as viewed in FIG. 3 on the spherical support portion 405 arranged at the center of the swash plate 10, so that the spherical support portion 405 is moved to the right. The force to the right as viewed in FIG. 3, acting upon the slide section 40 through the spherical support portion 405, is transmitted to the spool 30 through the thrust bearing 116, so that the spool 30 is moved until the same is abutted against the bottom of the rear housing 13. This state is illustrated in FIG. 3, in which the discharge capacity of the compressor is brought to the minimum.

The refrigerant drawn through a suction port (not shown) connected to an evaporator of a refrigeration cycle enters the suction space 70 at the center of the cylinder blocks 5 and 6, then passes through the suction passage 73, and enters the suction chamber 74 on the rear side. Subsequently, the refrigerant gas is drawn into the working chamber 60 through the suction port 25 and the suction valve 12, at the suction stroke of the piston 7. The drawn refrigerant gas is compressed at the compression stroke. When the refrigerant gas is compressed to a predetermined pressure, the refrigerant gas pushes to open the discharge valve 22 through the discharge port 24, and is discharged to the discharge chamber 93. The refrigerant gas at high pressure passes through the discharge passage, and is discharged to a condenser (not shown) of the refrigeration cycle through the discharge port.

Since, at this time, the top dead center of the piston 7 is displaced following reduction in the angle of inclination of the swash plate 10 and movement of the center of rotation thereof, the first working chamber 50 on the front side is large in dead volume. Accordingly, the first working chamber 50 is lower in compression ratio than the second working chamber 60 on the rear side, so that the pressure of the refrigerant gas within the first working chamber 50 is lower than that within the discharge chamber 90 into which the discharge pressure within the second working chamber 60 on the rear side is introduced. Thus, suction and discharge actions of the refrigerant gas are not carried out within the first working chamber 50 on the front side.

On the other hand, if the performance of the compressor required by the refrigeration cycle is high, high-pressure gas is introduced into the control pressure chamber 200 by the control valve 400. Accordingly, the pressure within the control pressure chamber 200 rises.

Therefore, the force acting upon the spool 30 to the left as viewed in FIG. 1, due to a differential pressure between the control pressure chamber 200 and the suction chamber 74 rises gradually with rotation of the compressor. When this force overcomes the aforementioned force urging the spherical support portion 405 to the right as viewed in FIG. 1, the spool 30 begins to move gradually to the left as viewed in FIG. 1. Under the action of the slot 166 in the shaft 1 and the pin 80, the swash plate 10 is increased in its inclination, while the center of rotation of the swash plate 10, that is, the spherical support portion 405 is moved to the left as viewed in FIG. 1. As the pressure within the control pressure chamber 200 rises further, the spool 30 is moved to the left as viewed in FIG. 1 until a shoulder 305 on the spool 30 is abutted against the rear side plate 11. Thus, the maximum capacity state is realized. This is the state illustrated in FIG. 4. In the state shown in FIG. 4, the refrigerant gas drawn through the suction port (not shown) enters the suction space 70 at the center, passes through the suction passages 71 and 73, and enters the suction chambers 72 and 74. At the suction stroke, the refrigerant gas enters the working chambers 50 and 60 through the respective suction ports 25 and the respective suction valves 9 and 12. The refrigerant gas is then compressed with displacement of the piston 7, and enters the discharge chambers 90 and 93 through the respective discharge ports 24 and the respective discharge valves 23 and 22. Then, the refrigerant gas passes through the discharge passages and is discharged through the discharge ports. The refrigerant gas discharged through the discharge ports join at the outside piping. In this state, both the working chambers 50 and 60 carry out the suction and discharge actions of the refrigerant gas.

Figure 4:
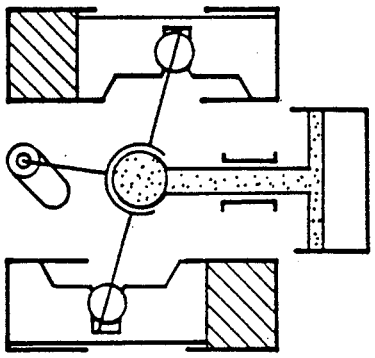
FIG. 4 is a view for explanation of a maximum capacity state of the compressor illustrated in FIG. 1.
Figure 5:
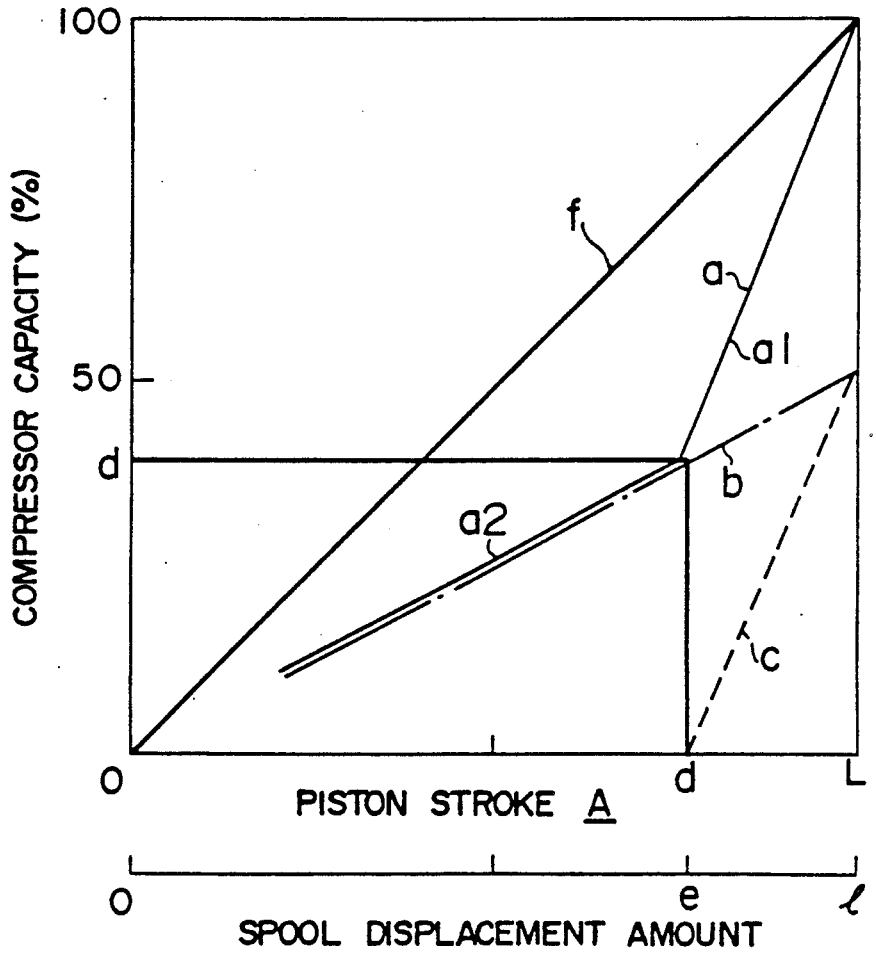
FIG. 5 is a graphical representation of capacity variable characteristics of the compressor illustrated in FIG. 1.

The solid line a in FIG. 5 represents the relationship between the piston stroke of the variable-capacity swash-plate type compressor and the compressor capacity. In FIG. 5, an amount of displacement of the spool is indicated on the assumption that the state of zero of the compressor capacity is 0, and the maximum capacity in FIG. 4 is 1. The solid line f represents a case where the working chambers 50 and 60 change in capacity uniformly. In a capacity control system of the compressor, there is almost no increase in dead volume in the second working chamber 60 on the rear side due to a decrease in the stroke of the piston, because change in the inclination of the swash plate 10 causes the stroke of the piston 7 to be varied and also causes the central position of the swash plate 10 to be altered. Therefore, as indicated by the dot-and-chain line b, the discharge capacity decreases gradually in accordance with the piston stroke. Conversely, the dead volume in the first working chamber 50 on the front side increases with a decrease in the piston stroke. The compression ratio decreases due to the increase in the dead volume between the spool displacement amounts l - e, so that the discharge capacity decreases suddenly as indicated by the broken line c in FIG. 5. At the point of time the maximum pressure or the discharge pressure within the working chamber 50 on the front side is brought to a value lower than the discharge pressure within the working chamber 60, that is, at the point d in FIG. 5, the suction and discharge actions of the working chamber 50 on the font side are suspended. Thus, the suction, compression and discharge actions of the refrigerant gas are carried out only within the working chamber 60 on the rear side, so that the compressor capacity varies from the solid line $a_1$ to the solid line $a_2$.

In the manner described above, the pressure within the control pressure chamber is changed to vary the displacement amount of the spool, thereby variably controlling the compressor capacity. However, consideration by the inventors of this application reveals that if the engaging slot 166 is brought to such a configuration that the top dead center of the piston 7 is made constant, it is difficult to maintain the displacement of the spool 30 at an appropriate position.

Figure 6:
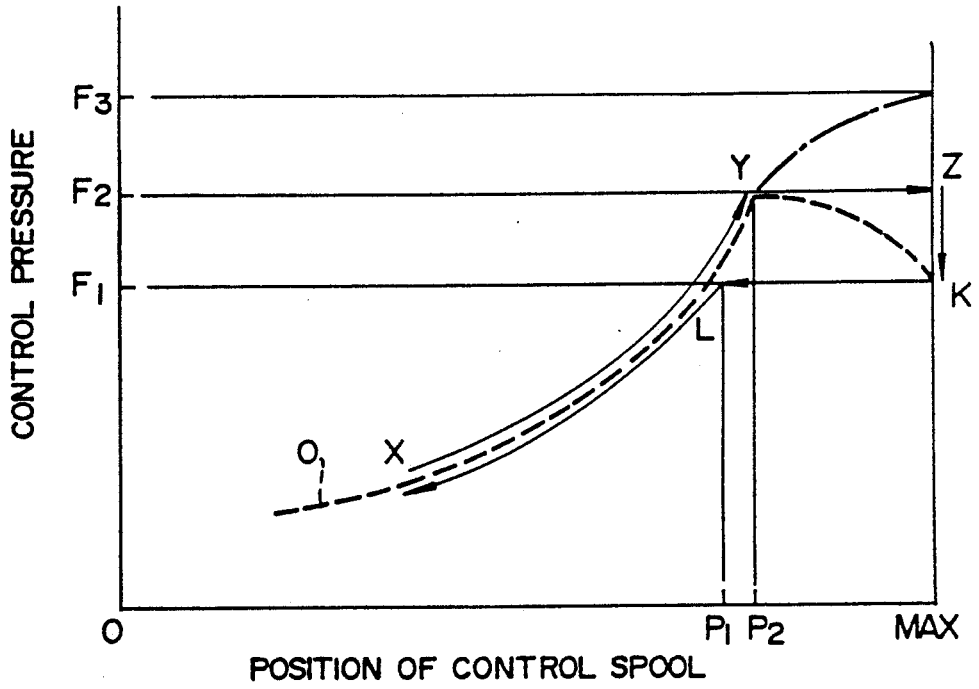
FIG. 6 is a graphical representation of the relationship between pressure within a control chamber and a position of a control spool of the compressor illustrated in FIG. 1.

If, as shown in FIG. 6, back pressure acting upon the spool 30, that is, the pressure within the control pressure chamber 200 rises successively, the spool is displaced in proportion to the increase in the back pressure during a period within which the spool back pressure reaches a predetermined pressure $F_2$ as indicated by the solid line X - Y in FIG. 6. In this connection, the abscissa represents the displacement of the spool 30. A displacement value of the spool corresponds to an amount of change in the angle of inclination of the swash plate 10 and, further, corresponds to the reciprocative stroke of the piston 7.

It has been ascertained that, as shown in FIG. 6, if the back pressure on the spool 30 is increased to a value equal to or higher than the predetermined value $F_2$, the stroke of the spool 30 is not displaced continuously, but increases immediately to the maximum stroke, as indicated by the solid line Y - Z in FIG. 6. That is, when the back pressure on the spool 30 is equal to or higher than the predetermined value $F_2$, the displacement is always retained at the position where the stroke of the spool 30 is brought to the maximum.

Conversely, when the back pressure on the spool 30 is decreased, the displacement of the spool 30 is retained at the maximum displacement position, even if the back pressure is decreased from the maximum back pressure load $F_3$ to the predetermined load $F_2$ and is further reduced to a load $F_1$ smaller than the predetermined load $F_2$, as indicated by the solid line Z - K in FIG. 6. When the back pressure on the spool 30 is lowered more than the predetermined value $F_1$ on the low-pressure side, the spool 30 is displaced suddenly by a predetermined amount of displacement, as indicated by the solid line K - L in FIG. 6.

Specifically, even if the back pressure on the spool 30 is changed to control the amount of displacement continuously as shown in FIG. 5, it has been difficult to retain and control the actual displacement of the spool 30 accurately in the vicinity of the maximum displacement position of the spool 30.

Consideration of the cause of the above difficulty by the inventors reveals that, at each stroke of the spool 30, the relationship between the displacement and the axial force of the shaft 1 acting on the spool 30 has a tendency as indicated by the broken line in FIG. 6. Specifically, if the stroke of the spool 30 is increased from the state in which the stroke of the spool 30, that is, the displacement amount from the side wall of the control pressure chamber 200 is minimum, the angle of inclination of the swash plate 10 is minimum, and the amount of reciprocative movement of the piston 7 is minimum as indicated by O in FIG. 6, the amount of reciprocative movement of the piston 7 increases with the increase in the stroke of the spool 30 and, correspondingly, the thrust force utilized to displace the spool 30 increases, as indicated by the broken line O-Y in FIG. 6. It is seen, however, that if an attempt is made to increase the stroke of the spool 30 more than the above, the force required for displacement of the spool 30 decreases conversely, as indicated by the broken line Y-K in FIG. 6. The state indicated by the broken line Y-K represents a region within which the reciprocative stroke of the piston 7 is controlled to the maximum amount. In other words, the state indicated by the broken line Y-K represents a region in which the discharge capacity of the compressor decreases slightly from the maximum discharge capacity.

Specifically, as shown in FIG. 6, the peak load $F_2$ (point Y) is seen between the stroke of the spool 30 and the thrust force required for movement of the spool 30. The stroke of the piston corresponding to the peak point $F_2$ is $P_2$. If the thrust force is increased more than the predetermined value $F_2$ as described above, the spool 30 advances immediately to the maximum amount (point Z in FIG. 6), and this state continues until the back pressure on the spool 30 decreases to a value equal to or lower than the thrust force $F_1$ required to retain the spool 30 at the maximum position. When the back pressure on the spool 30 is brought to a value equal to or lower than the thrust force $F_1$, the spool 30 is displaced from the point K immediately to the point L. The displacement of the spool 30 at the point L is $P_1$.

Consideration by the inventors of this application reveals that, the reason why there is provided the characteristics as shown in FIG. 6 is that, in the swash-plate type compressor, the dead volume occurs only in the first working chamber 50 in the state in which the spool 30 is less in displacement. This operation will be described below with reference to FIG. 7.

Figure 7:
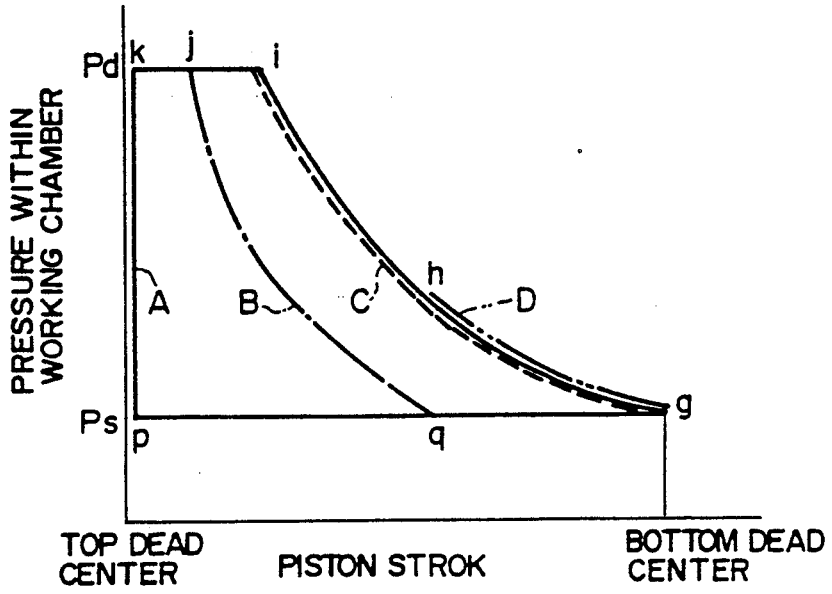
FIG. 7 is a graphical representation of the relationship between a stroke of a piston and pressure within a working chamber of the compressor illustrated in FIG. 1.

FIG. 7 shows the relationship between the stroke of the piston 7 and the pressure within the working chamber 50, in other words, the relationship between the volume of the working chamber 50 and the pressure within the working chamber 50. The solid line A in FIG. 7 represents a state in which the piston 7 moves forwardly to the maximum stroke, that is, a maximum discharge capacity state of the compressor. Further, the dot-and-chain line B in FIG. 7 represents a state in which the angle of inclination of the swash plate 10 decreases slightly and, correspondingly, the forwardly movable amount of the piston 7 decreases. Accordingly, in the state indicated by the dot-and-chain line B, a predetermined dead volume is produced between the piston 7 and the side plate 8. Furthermore, the broken line C in FIG. 7 represents a state in which the angle of inclination of the swash plate 10 further decreases so that the dead volume increases. Moreover, the two-dot-and-chain line D in FIG. 7 represents a state at the time the angle of inclination of the swash plate 10 is brought to the minimum and, correspondingly, the amount of reciprocative stroke of the piston 7 is brought to the minimum, so that the dead volume is brought to the maximum.

The state, in which the piston 7 is displaced to the maximum position as indicated by the solid line A in FIG. 7, will first be described. As the piston 7 is moved forwardly from the position indicated by g in FIG. 7 where the piston 7 is moved most rearwardly, the volume of the working chamber 50 decreases, and the pressure within the working chamber 50 increases, as indicated by g - h - i in FIG. 7. When the pressure within the working chamber 50 reaches a predetermined pressure Pd, the discharge valve 24 is opened so that the pressure within the working chamber 50 does not increase more than that, as indicated by i - j - k in FIG. 7. When the piston 7 starts to move rearwardly after the piston 7 has been displaced to the maximum stroke as indicated by the point k in FIG. 7, the suction port 25 is opened, so that the pressure within the working chamber 50 decreases immediately to the suction pressure Ps as indicated by p and, subsequently, the piston is again returned to the rearward end position indicated by g in FIG. 7. That is, in the state in which the piston is displaced to the maximum, a change in pressure takes place at the interior d of the working chamber 50, with a cycle of g, i, k, p and g.

Figure 10:
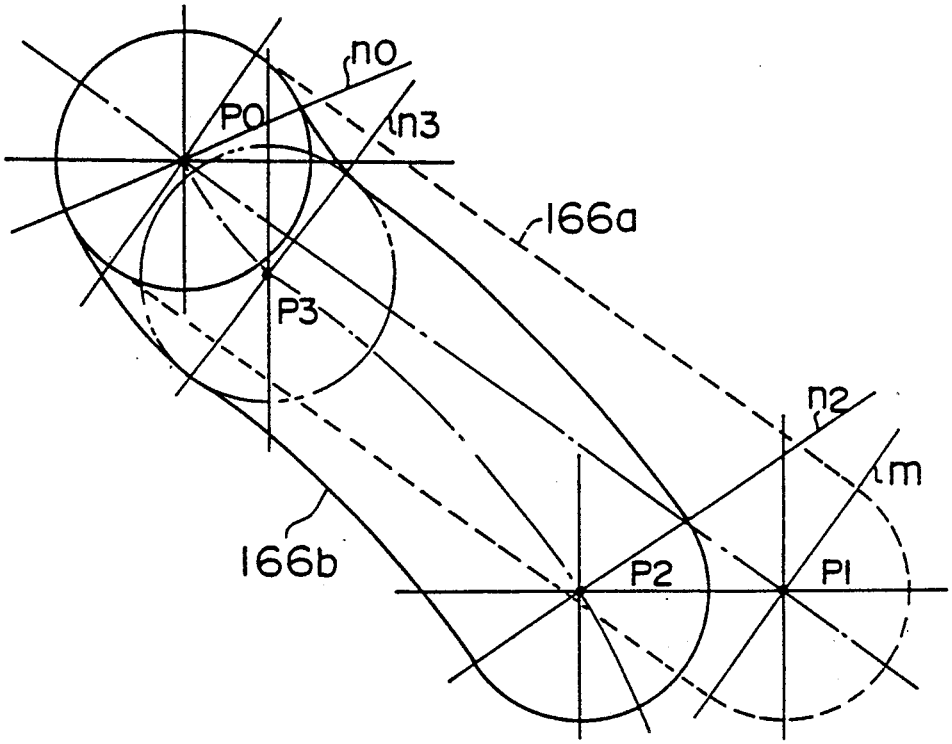
FIG. 10 is a view for explanation of an embodiment of the slot in the shaft according to the invention.

When the angle of inclination of the swash plate 10 is reduced slightly so that a dead volume occurs at the forward end of the piston 7, a predetermined volume is retained within the working chamber 50 as indicated by the dot-and-chain line B in FIG. 10. Accordingly, even if the piston 7 moves rearwardly from this state, the refrigerant retained within the working chamber 50 again expands as indicated by the dot-and-dash line j - g in FIG. 7, so that the pressure equal to or higher than the suction pressure Ps is retained within the working chamber 50 during the reexpansion of the refrigerant.

When the angle of inclination of the swash plate 10 is reduced further, and the stroke amount of the piston 7 decreases so that a large dead volume is formed within the working chamber 50, the discharge valve 24 is not opened even during forward movement of the piston 7. That is, the pressure within the working chamber 50 during forward movement of the piston 7 is not brought to a value equal to or higher than the discharge pressure Pd. This state is indicated by the broken line C in FIG. 10. In this case, the pressure within the working chamber 50 and the volume thereof repeat the motion g - h - i - h - g in FIG. 10. If the angle of inclination of the swash plate 10 is reduced further, and the moving stroke of the piston 7 decreases further, the state is finally brought to one indicated by the two-dot-and-chain line in FIG. 7. In this case, the suction and the discharge are not carried out within the working chamber 50, so that the relationship between the volume of the working chamber 50 and the pressure therewith is brought to a state g - h - g.

As described above, by occurrence of a dead volume within the working chamber 50, the pressure within the working chamber 50 varies during the reciprocative moving cycle of the piston.

Figure 8:
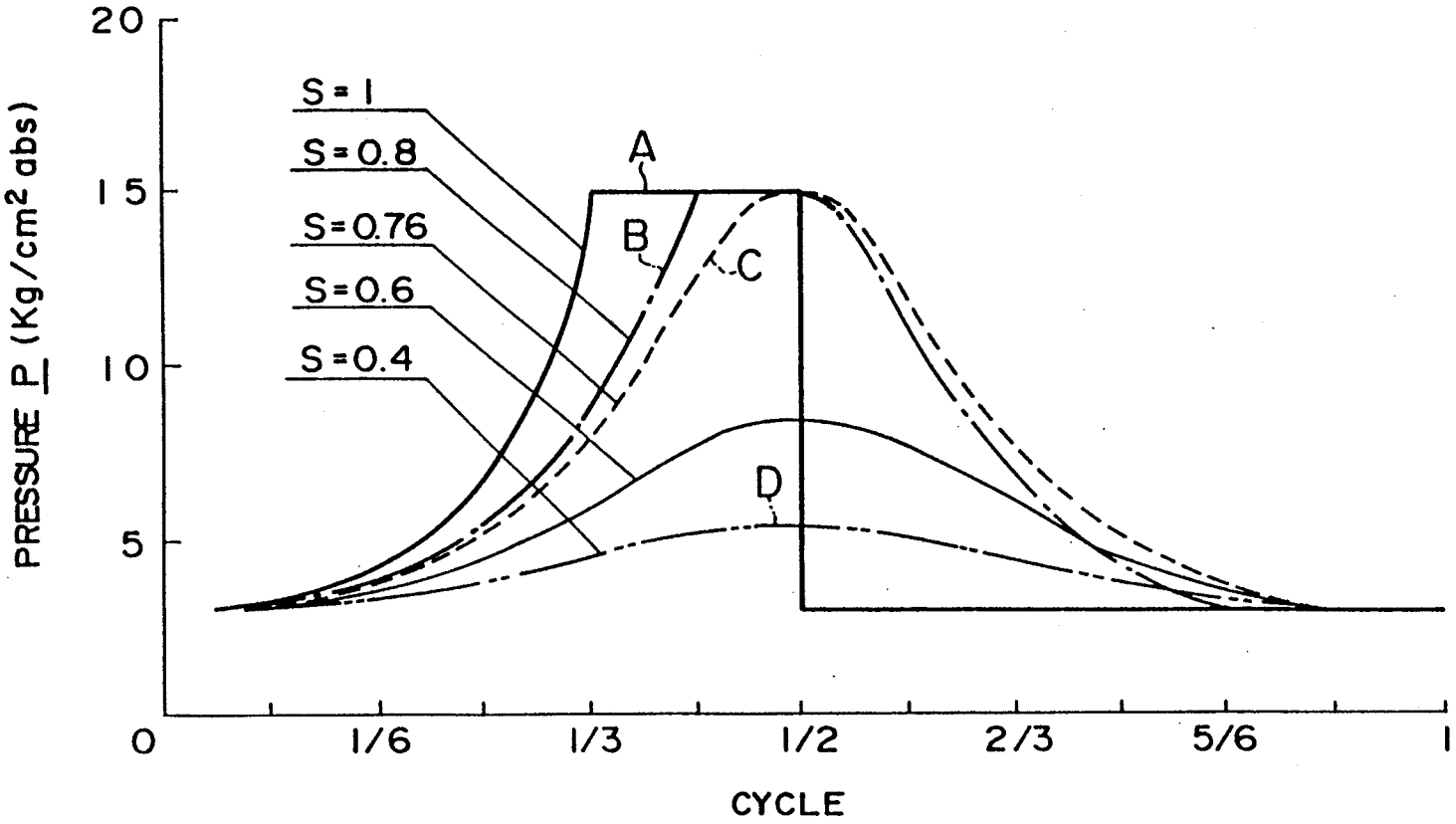
FIG. 8 is a graphical representation of the relationship between reciprocative movement of the piston and the pressure within the working chamber of the compressor illustrated in FIG. 1.

FIG. 8 is a graph showing the relationship between the pressure within the working chamber 50 and the cycle of the reciprocative motion of the piston 7. In FIG. 8, the solid line A corresponds to the state of the solid line A in FIG. 7. In this state, no dead volume occurs at the forward end of the piston 7, so that when the piston 7 starts to move rearwardly, the pressure within the working chamber 50 is immediately reduced to the suction pressure Ps. On the other hand, the dot-and-chain line B in FIG. 8 corresponds to the state of the dot-and-chain line B in FIG. 7. In this state, a dead volume occurs within the working chamber 50, and the remainder of the pressure due to the dead volume is seen in the working chamber 50. That is, even when the piston 7 performs the rearward movement, the pressure within the working chamber 50 is not immediately reduced to the suction pressure, but decreases gradually from the discharge pressure Pd toward the suction pressure Ps. Further, the broken line C in FIG. 8 corresponds to the state of the broken line C in FIG. 7. When the dead volume increases to this state, the pressure fluctuation within the working chamber 50 is brought to substantially sinusoidal one, so that the pressure within the working chamber 5 does not decrease to a value equal to or lower than the suction pressure Ps.

Furthermore, the two-dot-and-chain line D in FIG. 8 corresponds to the state of the two-dot-and-chain line D in FIG. 7. In this state, the pressure fluctuation is brought to substantially sinusoidal one, similarly to the case indicated by the broken line C, so that no compression stroke is carried out. In the state indicated by the two-dot-and-chain line D, moreover, pressure fluctuation within the working chamber 50 decreases, and the maximum pressure within the working chamber 50 decreases.

The broken line Y-K indicated in FIG. 6 represents a region in which, in FIG. 7, the pressure volume state within the cycle reaches the broken line C from the solid line A. That is, in this region, as will be apparent from FIG. 8, the pressure remains within the working chamber 50 so that the force, with which the pressure within the first working chamber 50 urges the piston 7 to the right as viewed in FIG. 1, increases.

Here, the force urging the piston 7 to the right by the pressure within the first working chamber 50 is brought to an action in such a direction as to increase the angle of inclination of the swash plate 10. That is, the angle of inclination of the swash plate 10 is increased by the pressure remaining within the working chamber 50, so that the reciprocative stroke amount of the piston 7 increases. The behavior during this is represented by a region indicated by the broken line Y-K in FIG. 6. In this region, the pressure remaining within the working chamber 50 rises with an increase in the dead volume. In this region, accordingly, if the mean is taken per one revolution of the shaft, the thrust force, with which the swash plate is urged to the right by the piston on the front side, increases with an increase in the dead volume.

As indicated by the broken line in FIG. 6, therefore, the relationship between the stroke of the control spool 30 and the pressure within the control chamber 200 is brought to a curve having a peak Y at a point where the working chamber 50 on the front side stops to discharge the refrigerant. Thus, in a region within which the stroke of the control spool 30 is larger than the peak Y, it is no longer possible to control the capacity of the compressor continuously.

Figure 9:
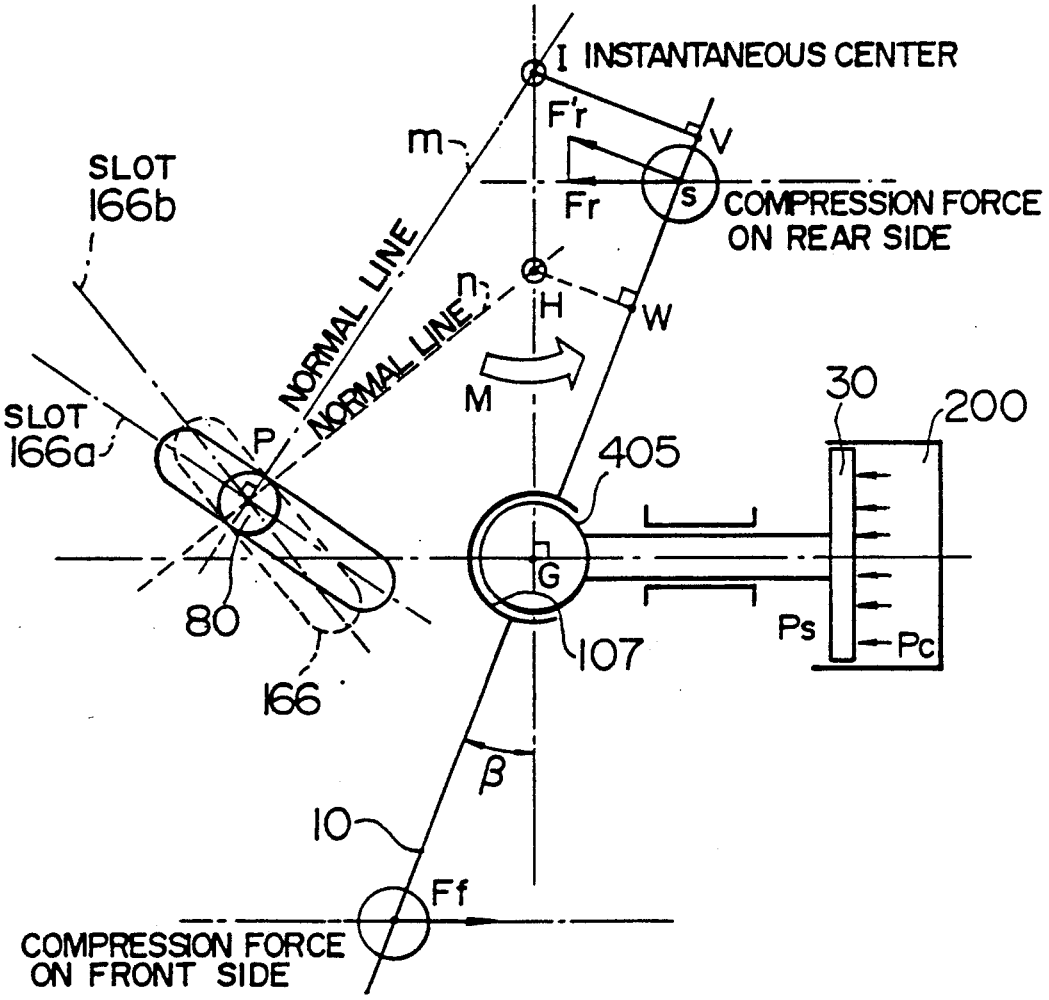
FIG. 9 is a view for explanation of the operation of a link constituted by a swash plate and a slot formed in the shaft of the compressor illustrated in FIG. 1.

Here, consideration will be made in detail to the relationship between the pressure within the working chambers 50 and 60 acting upon the piston 7 and the pressure within the control chamber 200 acting upon the spool 30. In FIG. 9, force F resulting from the compression force of the piston is transmitted to the swash plate 10 through the shoes 18 and 19. At this time, a moment M occurs on the swash plate 10, centering around an intersecting point I between a normal line m of the slot 166*a* at the position P of the pin 80 and the center line G of the spherical support portion 405. The intersecting point I is equal to an instantaneous center of a link composed of the slot 166*a*, the spherical surface section 107 and the swash plate 10.

The thrust force acting upon the control spool 30 is one for generating a moment in the reverse direction centering around the point I, in order to maintain the inclination of the swash plate 10 constant against the moment M. Accordingly, in order to bring the relationship between the thrust force acting upon the control spool 30 and the discharge capacity of the compressor, to monotonously increasing one, the relationship between the moment M and the thrust force acting upon the spool 30 should be brought to monotonously increasing one.

In connection with the above, if the slot 166 is formed into a configuration which uses such an approximate line as to make the top dead center of the piston on the rear side constant (configuration indicated by 166*a* in FIG. 10), there has been a tendency that the moment M decreases in the vicinity of the maximum capacity under the influence of the dead volume on the front side, as described previously. If, therefore, the configuration of the slot is inclined in the vicinity of the maximum capacity as indicated by 166*b* in FIG. 10, the normal line n of the slot 166*b* at the position of the pin 80 becomes smaller in inclination than the normal line m of the aforesaid slot 166*a*, so that the instantneous center of the link shifts from I to H in FIG. 9. Since, at this time, the center of the moment has moved from the point I to the point H, the thrust force acting upon the spool 30 in order to retain the inclination of the swash plate 10 increases correspondingly to a decrease in the arm length from IG to HG. That is, the pressure Pc within the control pressure chamber required to keep the angle of the swash plate 10 constant varies, if the inclination of the slot 166 vaies, even if the conditions of the working chambers 50 and 60 are the same as each other. Accordingly, if the inclination of the slot 166 is increased continuously in the region in which the moment M decreases in the vicinity of the maximum capacity under the influence of the aforementioned dead volume, the decrease in the moment M can be compensated for so that the requisite pressure within the control pressure chamber 200 is increased. That is, it is made possible to bring the relationship between the stroke of the control spool 30 and the pressure within the control pressure chamber 200 to monotonously increasing one, without the use of the supplementing means such as a spring unit or the like.

The configuration of the slot according to the embodiment of the invention is in the form of the letter S in which the slot configuration has a downwardly convex curve from the position $P_0$ of the pin at the capacity to the point $P_3$ where the working chamber 50 on the front side stops to discharge, a inflection point in the vicinity of the point $P_3$, and an upwardly convex curve to the position $P_2$ of the pin 80 at the minimum capacity. When the position of the pin 80 moves from $P_0$ to $P_3$, the inclination of the normal line increases gradually from $n_0$ to $n_3$. Therefore, following movement of the position of the spool from $P_0$ to $P_3$ indicated in FIG. 11, the requisite control pressure supplements the increase in the control pressure due to the dead volume and decreases monotonously as indicated by the solid line $\alpha$. In FIG. 10, on the other hand, when the position of the pin 80 moves from $P_3$ to $P_2$, the inclination of the normal line decreases from $n_3$ to $n_2$. Since, here, variation in the inclination of the normal line is gentle, the control pressure indicated by the solid line $\alpha$ in FIG. 11 decreases gently following movement of the spool position from $P_3$ to $P_2$. In this case, the decrease in the control pressure is gentle as compared with the slot 166*a* formed into a linear configuration as indicated by the broken line $\beta$ in FIG. 11, so that, even if the position $P_2$ of the minimum capacity is reached, the control pressure is not brought to a value equal to or lower than the suction pressure Ps.

That is, by the use of the above-described slot in the form of the letter S, the control pressure corresponding to the position of the control spool 30 can be brought to a monotonously increasing relationship within a range equal to or lower than the discharge pressure and equal to or higher than the suction pressure. As a result, by appropriately introducing the discharge pressure or the suction pressure into the control pressure chamber by the control valve, it is made possible to control the discharge capacity of the compressor from the maximum capacity to the minimum capacity continuously and smoothly.

Figure 12:
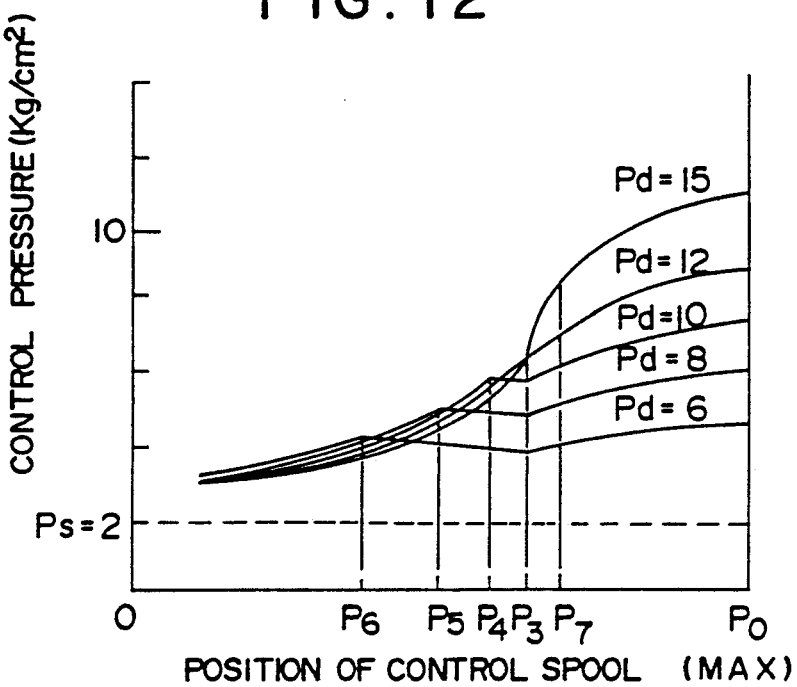
FIG. 12 is a graphical representation showing a state in which the relationship between the pressure within the control chamber and the position of the spool varies depending upon the discharge pressure of the compressor according to the embodiment of the invenion.

In connection with the above, the arrangement of the compressor according to the embodiment has been described on the assumption of the running conditions due to the compression ratio at the steady running. However, there may be a case where, under the running condition in which the compression ratio fluctuates over a wide range, the relationship between the spool position and the control pressure is not necessarily brought to monotonously increasing one because the discontinuous point $P_3$ of the control pressure due to the influence of the dead volume varies. FIG. 12 shows a change in the control pressure characteristic, due to a change in the discharge pressure, in case where an S-shaped slot is designed on the basis of the discontinuous point $P_3$ at the time the suction pressure is 2 kg/cm$^2$ and the discharge pressure is 12 kg/cm$^2$. In this case, the inflection point moves toward $P_3$, $P_4$, $P_5$ and $P_6$ as the compression ratio lowers, so that a section slanting rightwardly and downwardly occurs in the characteristic. In this case, therefore, it is desirable to jointly use supplementing means such as a spring unit or the like.

Figure 13:
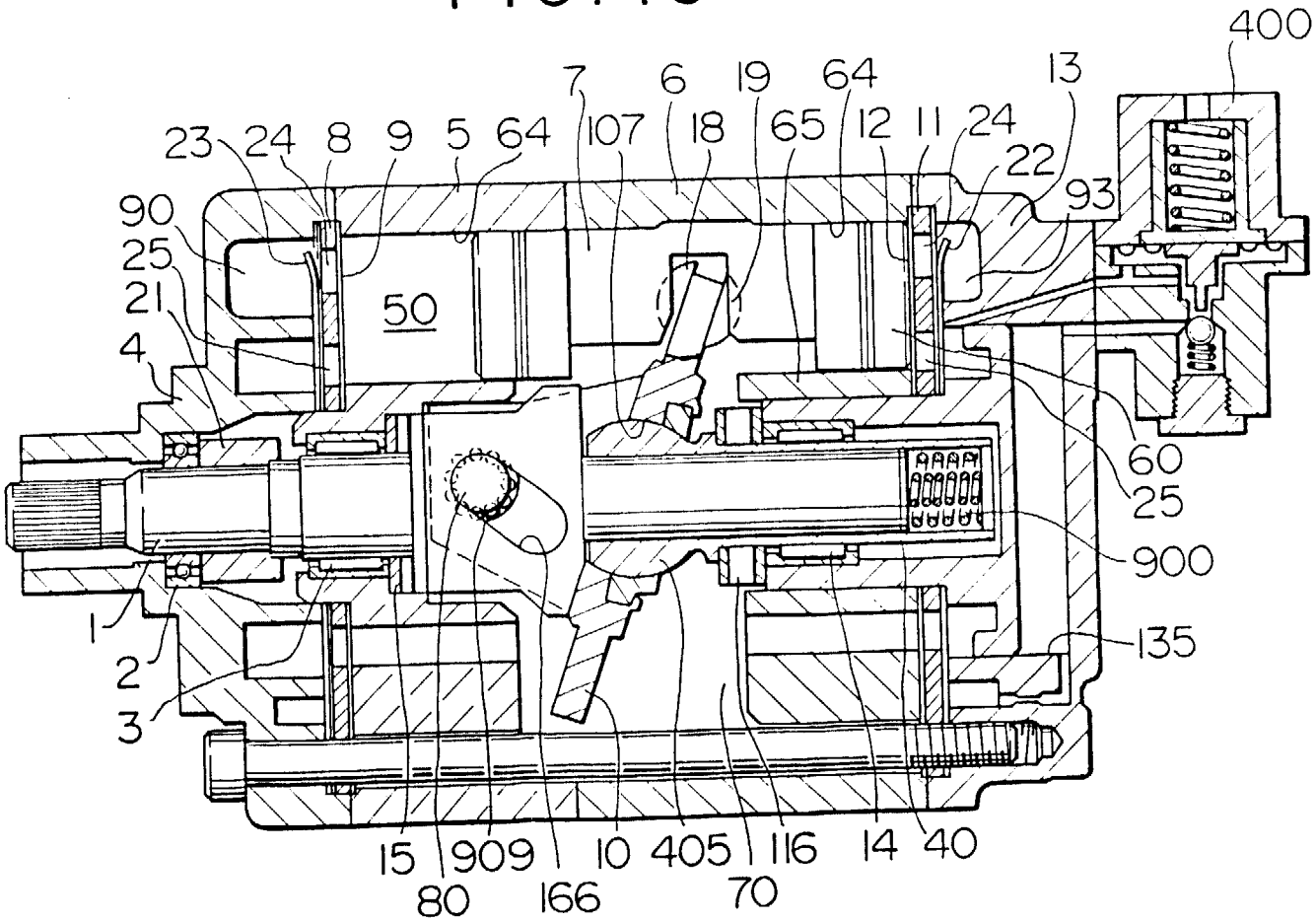
FIG. 13 is a cross-sectional view of another example of the compressor according to the invention.

FIG. 13 shows an embodiment to which a spring unit 900 is added. In this embodiment, the rightwardly and downwardly slanting section of the characteristic is corrected by additional load of the spring unit 900. Moreover, as shown in FIG. 12, since the rightwardly and downwardly slanting section of the characteristic is small in inclination, the spring unit having a weak spring constant can be employed, making it possible to secure durability of the spring unit sufficiently. The remaining arrangement of the embodiment illustrated in FIG. 13 is similar to that of the embodiment shown in FIG. 1, and similar component parts are designated by the same reference numerals.

Figure 11:
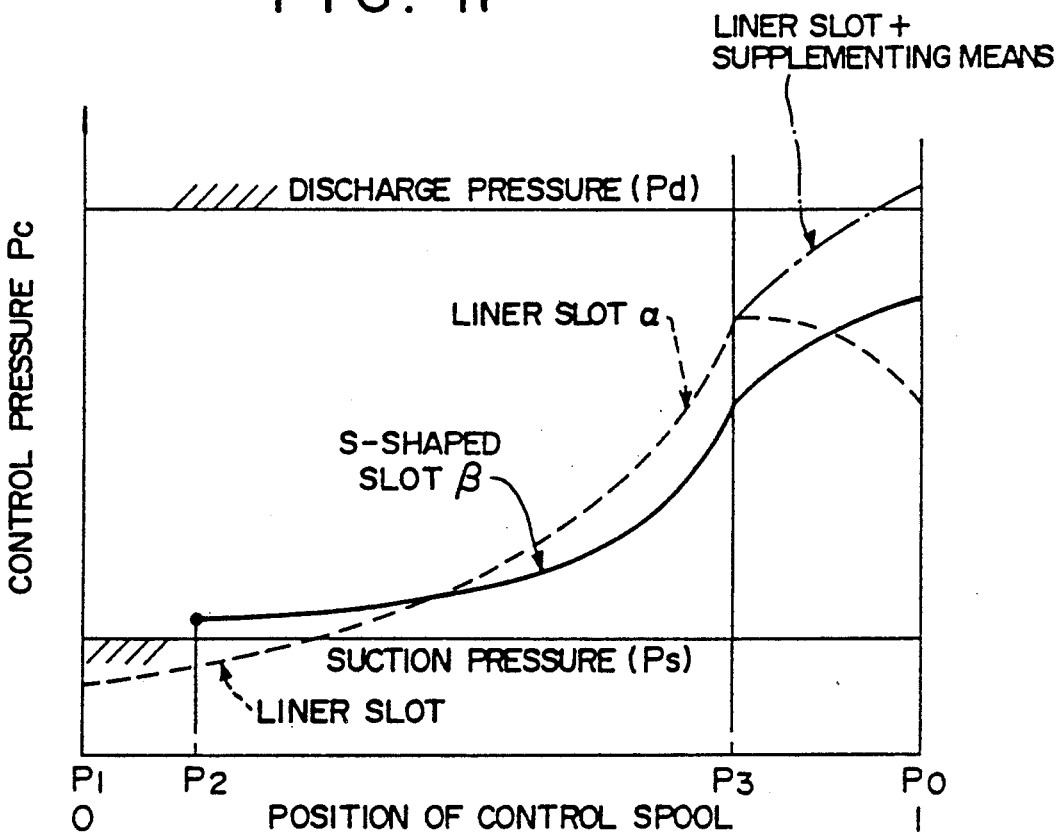
FIG. 11 is a graphical representation of the relationship between the pressure within the control chamber and the position of the spool in the compressor according to the embodiment of the invention.

In connection with the above, it is desirable that the curve having the inflection point in the vicinity of $P_3$ indicated in the previous embodiment has such a characteristic that the curve decreases monotonously as far as possible during a period within which the control spool reaches $P_1$ from $P_0$ in FIG. 11. In practice, however, the curve may be formed by two circles having a point of contact in the vicinity of $P_2$ in FIG. 10, in order to facilitate processing. Furthermore, a downwardly convex curve and a upwardly convex curve may be connected to each other through a straight line arranged between them. Moreover, a line between the points $P_3$ and $P_2$ in FIG. 10 may be straight.

Figure 14:
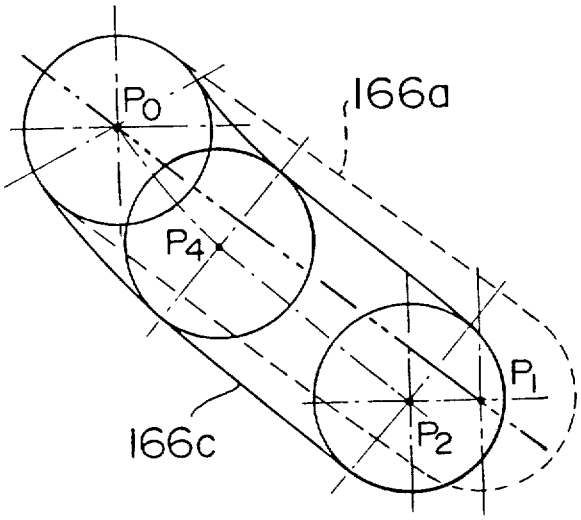
FIG. 14 is a view for explanation of another embodiment of the slot in the shaft according to the invention.

An example of the aforementioned modification is shown at reference numeral 166C in FIG. 14 in which the line between the points $P_3$ and $P_2$ in FIG. 10 is straight. A section between the pin position $P_0$ at the maximum capacity and the pin position $P_4$ at the intermediate capacity has a downwardly convex curve configuration. Further, a section between the pin position $P_4$ and the pin position $P_2$ at the minimum capacity has a straight-line configuration smoothly connected to the above curve. The configuration has an inflection point in the region from $P_0$ to $P_2$, specifically at P.

Figure 15:
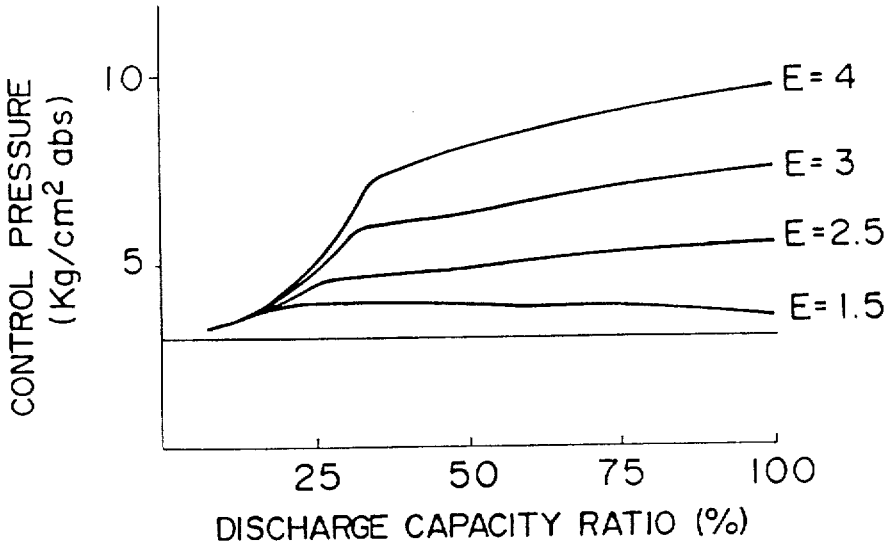
FIG. 15 is a diagram showing a state in which the relationship between the pressure within the control pressure chamber and the spool position of the compressor having the slot shown in FIG. 14 varies depending upon the discharge pressure of the compressor.

The relationship between the control pressure and the discharge capacity in the configuration of the engaging slot 166c illustrated in FIG. 14 is shown in FIG. 15. As shown in FIG. 15, when the compression ratio $\epsilon$ is high, a ratio between the control pressure and the discharge capacity has the monotonously increasing relationship, so that continuous control is possible. FIG. 15 shows, however, that when the compression ratio is low (compression ratio $\epsilon=1.5$, for example), the ratio between the control pressure and the discharge capacity is brought to a rightwardly and downwardly slanting characteristic on the side of the large discharge capacity, so that the capacity control is not brought to continuous one.

Figure 16:
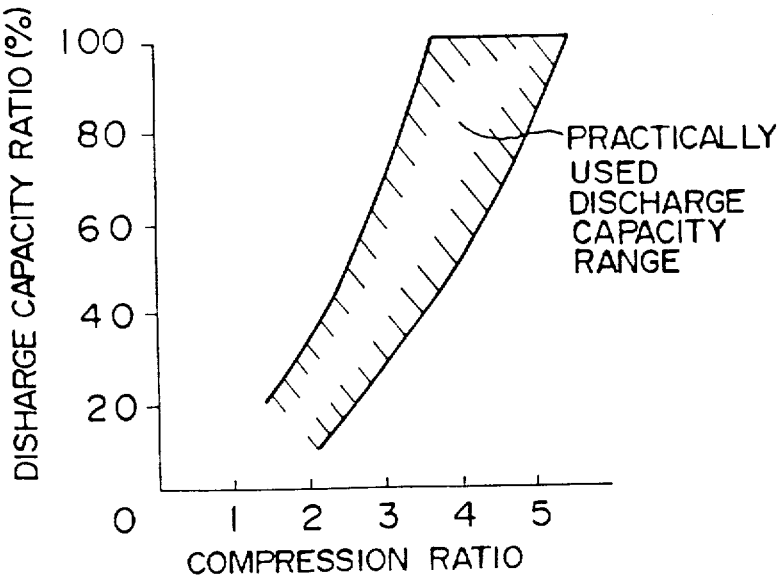
FIG. 16 is a diagram showing a discharge capacity range employed in practice in a refrigerant compressor of an air conditioning system for automotive vehicles.

It has been ascertained by experiments conducted by the inventors of this application, however, that in case where the compressor is employed as a refrigerant compressor of an air conditioning system for automotive vehicles, the discharge capacity and the compression ratio are capable of occurring practically within a limited range as shown in FIG. 16.

Accordingly, in practice, when the compression ratio is extremely low ($\epsilon=1.5$, for example), the compressor is used only on the side of the low discharge capacity and, therefore, there is no hindrance even if the relationship between the discharge capacity and the control pressure slants rightwardly and downwardly on the side of the large capacity, as shown above.

As will be seen from the foregoing, even in the engaging slot configuration having an inflection point as illustrated in FIG. 14, it is possible to control the discharge capacity of the compressor continuously and smoothly under the actual use condition. This configuration has an advantage that the discharge capacity can be controlled continuously without the use of any supplementing means, even at the intermediate capacity.

In connection with the above, since the point at which the configuration of the engaging slot is greatly changed, that is, the point $P_3$ in the example of FIG. 10 or the point $P_4$ in the example of FIG. 14, fluctuates depending upon factors such as the compression ratio and the like as mentioned previously, it is desirable that this point is determined from compressor to compressor. Generally speaking on a compressor of an air conditioning system for automotive vehicles, however, the point is located at a position corresponding to 40% to 50% of the maximum discharge capacity of the compressor. It is to be noted that this is a volumetric ratio and is not in proportion to the length of the slot in the example of FIG. 10.

As will be apparent from the above description, the arrangement of the swash-plate type compressor according to the invention is such that the engaging slot between the swash plate and the drive shaft is brought to a nonlinear configuration, whereby the thrust force due to moment tending to incline the swash plate is balanced with the driving force of the spool, to displace the swash plate, so that the reciprocative stroke of the piston is controlled. With such arrangement of the swash-plate type compressor according to the invention, by controlling the control pressure applied to the spool, it is made possible to ensure that the discharge capacity of the compressor is controlled continuously.

The invention has been described with reference to the embodiments. It is to be understood, however, that the various modifications can be made to the invention within the scope of the appended claims.

What is claimed is:

1. A variable-capacity swash-plate type compressor comprising:

housing means having defined therein a plurality of cylinder chambers extending parallel to each other;

a shaft rotatably supported by said housing means and extending parallel to said plurality of cylinder chambers;

swash plate means connected to said shaft for rotation therewith and for wobbling motion due to the rotation;

a plurality of pistons slidably arranged respectively within said cylinder chambers, each of said pistons being subject to the wobbling motion of said swash plate means and being reciprocated within a corresponding one of said cylinder chambers;

a plurality of pairs of first and second chambers, each pair of first and second chambers being defined respectively at opposite ends of a corresponding one of said pistons by the piston and an inner surface of a corresponding one of said cylinder chambers, to carry out suction, compression and discharge of fluid;

spool means arranged for movement in coaxial relation to said shaft, said spool means retaining said swash plate means for wobbling motion at a center of rotation of said swash plate means, wherein movement of said spool means causes a position of the center of rotation of said swash plate means to be displaced axially of said shaft and causes said swash plate means to be varied in inclination, thereby varying a reciprocative stroke of each piston, so as to make forwardly-movable positions of the pistons in the respective first working chambers and forwardly-movable positions of the pistons in the respectively second working chambers different from each other;

said shaft and said swash plate means being connected to each other through slidable engagement between an engaging slot formed in one of said swash plate means and a pin provided on the other; and said engaging slot being formed into a non-linear configuration, which has an inflection point at a position corresponding to an intermediate discharge capacity of the compressor, in such a manner that an angle defined between a normal line of said engaging slot and an axis of said shaft decreases in both regions wherein the compressor is brought respectively to a larger discharge capacity than the intermediate discharge capacity and to a smaller discharge capacity than the intermediate discharge capacity.

2. A compressor according to claim 1, wherein the configuration of said engaging slot is formed by two arcs, a point of contact between said two arcs being located at said position corresponding to the intermediate discharge capacity of the compressor, and said two arcs being different in orientation from each other.

3. A compressor according to claim 1, wherein the configuration of said engaging slot is formed by a curve of higher order having the inflection point at the position corresponding to the intermediate discharge capacity of the compressor.

4. A compressor according to claim 1, wherein the configuration of said engaging slot is formed by a curve of higher order and a straight line.

5. A compressor according to claim 1, wherein said shaft is formed with a flat plate section extending axially, and said swash plate means is provided with a slit in which said flat plate section is fitted, said flat plate section being engaged with said slit whereby said swash plate means is connected to said shaft for rotation therewith and for wobbling motion relative thereto.

6. A compressor according to claim 5, wherein said engaging slot is formed in said flat plate section of said shaft, and said slit in said swash plate means is formed with a pin-inserting bore, said pin being inserted in said engaging slot and said pin-insertion bore, to connect said swash plate means and said shaft to each other.

7. A compressor according to claim 1, wherein said spool means has a cylindrical member movable axially on said shaft, said cylindrical member being arranged on the opposite side of said second working chambers from said engaging slot so as to alter the forwardly-movable positions of the pistons in the respective first working chambers thereby controlling the discharge capacity of the compressor.

8. A compressor according to claim 7, wherein said cylindrical member of said spool means has a spherical support portion provided on an end of said cylindrical member on the side of said first working chambers, and said swash plate means includes a spherical recess complementary to said spherical support portion, said spherical recess being provided at the position of the center of rotation of said swash plate means, said swash plate means being connected to said spool means for wobbling motion through engagement between said spherical support portion and said spherical recess.

9. A compressor according to claim 1, further comprising control means for controlling displacement of said spool means, said spool means including a flange member having axial one end face exposed to suction pressure of the compressor, said control means including a control pressure chamber formed in contact with the other axial end face of said flange member of said spool means and a control valve for selectively introducing the suction pressure and discharge pressure of the compressor into said control pressure chamber, the displacement of said spool means being controlled by a differential pressure acting upon said flange member of said spool means.

10. A variable-capacity swash-plate type compressor comprising:

housing means having defined therein a plurality of cylinder chambers extending parallel to each other;

a shaft rotatably supported by said housing means and extending parallel to said plurality of cylinder chambers;

swash plate means connected to said shaft for rotation therewith and for wobbling motion due to the rotation;

a plurality of pistons slidably arranged respectively within said cylinder chambers, each of said pistons being subject to the wobbing motion of said swash plate means and being reciprocated within a corresponding one of said cylinder chambers;

a plurality of pairs of first and second chambers, each pair of first and second chambers being defined respectively at opposite ends of a corresponding one of said pistons by the piston and an inner surface of a corresponding one of said cylinder chambers, to carry out suction, compression and discharge of fluid;

spool means arranged for movement in coaxial relation to said shaft, said spool means retaining said swash plate means for wobbling motion at a center of rotation of said swash plate means, wherein movement of said spool means causes a position of the center of rotation of said swash plate means to be displaced axially of said shaft and causes said swash plate means to be varied in inclination, thereby varying a reciprocative stroke of each piston, so as to make forwardly-movable positions of the pistons in the respective first working chambers and forwardly-movable positions of the pistons in the respectively second working chambers different from each other;

said shaft and said swash plate means being connected to each other through slidable engagement between an engaging slot formed in one of said swash plate means and a pin provided on the other; and said engaging slot having at least a section thereof between positions corresponding respectively to a maximum discharge capacity and an intermediate discharge capacity of the compressor, said section being formed into a non-linear configuration in such a manner that an angle defined between a normal line of said engaging slot an axis of said shaft decreases at a position where the compressor is brought to a large discharge capacity;

wherein the configuration of said engaging slot is formed by two arcs, a point of contact between said two arcs being located at said position corresponding to the intermediate discharge capacity of the compressor, and said two arcs being different in orientation from each other.

* * * * *

UNITED STATES PATENT AND TRADEMARK OFFICE

CERTIFICATE OF CORRECTION

PATENT NO. : 5,002,466

DATED : March 26, 1991

INVENTOR(S) : INAGAKI, et al.

It is certified that error appears in the above-identified patent and that said Letters Patent is hereby corrected as shown below:

In the Drawings:

Add the omitted 3 sheets of drawings consisting of Figures 13, 14, 15 and 16.

Signed and Sealed this

Eighth Day of March, 1994

Bruce Lehman

*Attest:*

BRUCE LEHMAN

*Attesting Officer*

*Commissioner of Patents and Trademarks*